US007949265B2

(12) United States Patent
Sakita et al.

(10) Patent No.: US 7,949,265 B2
(45) Date of Patent: May 24, 2011

(54) TONER SUPPLY DEVICE, DEVELOPING DEVICE AND IMAGE FORMING APPARATUS WITH RESIDUAL QUANTITY OF TONER BASED CONTROL

(75) Inventors: Hirofumi Sakita, Tenri (JP); Takeshi Murata, Sakai (JP); Yoshinori Ohtsuka, Ikoma (JP); Masaaki Ohtsuki, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 365 days.

(21) Appl. No.: 12/184,276

(22) Filed: Aug. 1, 2008

(65) Prior Publication Data

US 2009/0047044 A1 Feb. 19, 2009

(30) Foreign Application Priority Data

Aug. 13, 2007 (JP) ..... 2007-210994

(51) Int. Cl.
*G03G 15/08* (2006.01)

(52) U.S. Cl. ..... 399/27; 399/260

(58) Field of Classification Search ..... 399/27, 399/258, 262, 260
See application file for complete search history.

(56) References Cited

U.S. PATENT DOCUMENTS

| | | | |
|---|---|---|---|
| 2003/0133722 A1* | 7/2003 | Kaiho | 399/27 |
| 2007/0058997 A1 | 3/2007 | Sakita et al. | |

FOREIGN PATENT DOCUMENTS

| | | | |
|---|---|---|---|
| JP | 63-216081 | | 9/1988 |
| JP | 07-140792 | | 6/1995 |
| JP | 08-137227 | | 5/1996 |
| JP | 09-211952 | | 8/1997 |
| JP | 2000-075627 | | 3/2000 |
| JP | 2003076125 | A * | 3/2003 |
| JP | 2003-208007 | | 7/2003 |
| JP | 2003-302871 | | 10/2003 |
| JP | 2004-046011 | | 2/2004 |
| JP | 2004-271999 | | 9/2004 |
| JP | 2004325910 | A * | 11/2004 |
| JP | 2005-241868 | | 9/2005 |
| JP | 2006-091589 | | 4/2006 |
| JP | 2007-078847 | | 3/2007 |

OTHER PUBLICATIONS

Computer Translation JP2006-091589A; Apr. 6, 2006.*

* cited by examiner

*Primary Examiner* — Quana M Grainger
(74) *Attorney, Agent, or Firm* — Renner, Otto, Boisselle & Sklar, LLP

(57) ABSTRACT

A toner supply device for supplying toner to a developing device includes: a first toner supply portion for supplying toner to a developing hopper; a second toner supply portion for supplying the stored toner to the first toner supply portion; a first toner supply driver for driving the first toner supply portion; a first residual toner quantity detector for detecting the residual toner quantity in the first toner supply portion; a second toner supply driver for driving the second toner supply portion; a second residual toner quantity detector for detecting the residual toner quantity in the second toner supply portion; and a controller for controlling the drives of the first and second toner supply drivers by switching on and off the drives of the first and second toner supply drivers in accordance with the residual toner quantities detected by the first and second residual toner quantity detectors.

11 Claims, 10 Drawing Sheets

*FIG. 8*

Determination on whether the residual toner quantity in toner cartridge is acceptable

| | | Drive torque for toner cartridge 8 (Nm) | |
|---|---|---|---|
| | | 0.49 | 1.08 |
| Residual toner quantity calculated based on the revolution count | 0 % (No toner) | OK | NG |
| | >0 % (Toner present) | NG | OK |

TONER SUPPLY DEVICE, DEVELOPING DEVICE AND IMAGE FORMING APPARATUS WITH RESIDUAL QUANTITY OF TONER BASED CONTROL

This Nonprovisional application claims priority under 35 U.S.C. §119(a) on Patent Application No. 2007-210994 filed in Japan on 13 Aug. 2007, the entire contents of which are hereby incorporated by reference.

BACKGROUND OF THE INVENTION (1) Field of the Invention

The present invention relates to a toner supply device for supplying toner to a developing device provided in an image forming apparatus such as an electrophotographic copier, printer or the like, and in particular relates to a method against trouble occurring with a toner cartridge during image forming.

(2) Description of the Prior Art

An image forming apparatus using an electrophotographic process typically includes a photoreceptor as a rotational image bearer, and a charger unit, an exposure unit, a developing portion, a transfer unit, a fixing unit, a cleaning unit and a charge erasing unit, all being arranged around the photoreceptor. The charger unit electrifies the photoreceptor surface uniformly. The exposure unit forms an electrostatic latent image by illuminating the electrified photoreceptor surface with light in accordance with image information. The developing portion tribo-electrifies the toner by agitation and supplies the tribo-electrified toner to the electrostatic latent image formed on the photoreceptor surface to form a toner image. The transfer unit transfers the toner image to a recording medium by imparting charge of a polarity that is opposite to that of the toner to the recording medium. The fixing unit fixes the transferred toner image to the recording medium by a means of heating and pressing. The cleaning unit collects the toner which has not been transferred to the recording medium and is left over on the photoreceptor surface. The charge erasing unit erases charge from the photoreceptor drum after toner image transfer. The thus constructed image forming apparatus using electrophotography forms a desired image on a recording medium.

Since the toner used for development in the developing portion is an item to be consumed, this image forming apparatus includes a toner supply portion that supplies toner to the developing hopper, which is a receptacle provided for storing toner. Usually, the toner supply portion is to supply toner to the developing hopper from a toner cartridge that is removably mounted to the image forming apparatus. When all the toner in the toner cartridge has been supplied to the developer and used up, the operation of the image forming apparatus stops. When the empty toner cartridge is replaced with a new toner cartridge so as to supply the toner to the developing hopper, the operation of the image forming apparatus can be restarted.

Recently, copiers, printers and similar image forming apparatuses using an electrophotographic process which are designed for heavy users who use the apparatus with very high frequency and hence consume a large quantity of toner, have been developed. In such an image forming apparatus, the number of times the toner cartridge is replaced is reduced by designing one toner cartridge to be able to hold as much toner as possible. Use of a large capacity toner cartridge that holds a large amount of toner can reduce the number of replacements and hence reduce the number of times the image forming operation stops. Accordingly, it is desirable to light the burden on the users who are unfamiliar in handling the apparatus.

Further, in such heavy-use machines, in order to avoid suspension of the image forming operation when the toner cartridge is replaced, a reserve tank is provided between the toner cartridge and the developing portion so as to allow for replacement of the toner cartridge without cessation of the image forming operation by using the toner from the reserve tank.

As an image forming apparatus in which the toner cartridge is replaceable without stoppage of the image forming operation, a patent document 1 discloses a configuration of an image forming apparatus which includes a plurality of toner cartridges having toner of the same color and a toner feed pipe having a plurality of inlets connected to the multiple toner cartridges and joining at a midway point to deliver the toner from the toner cartridges to the developing hopper. In the image forming apparatus disclosed in this patent document 1 (Japanese Patent Application Laid-open Hei 8 No. 137227), one of the multiple toner cartridges is used to supply toner, and when the toner of the toner cartridge is used up, another toner cartridge is used to supply toner. Accordingly, the image forming operation will not be disrupted. In this case, the other toner cartridge(s) serves as a reserve tank.

Another patent document 2 (Japanese Patent Application Laid-open 2003-208007) discloses a color image forming apparatus in which a plurality of toner cartridges for black toner which is more consumed than the color toners, i.e., yellow, magenta and cyan, are provided, and the multiple toner cartridges for black toner are arranged side by side in a row. According to the image forming apparatus disclosed in this patent document 2, provision of multiple black toner cartridges makes it possible to prevent increase of the frequency of stoppage of the image forming operation due to the black toner being empty. Further, since the black toner cartridges are arranged abreast, it is possible to save the space for accommodating toner and also prevent toner cartridges from being mounted into wrong positions.

Though in the image forming apparatuses disclosed in patent documents 1 and 2, a plurality of toner cartridges for storing toner of the same color are provided to realize a (continuous run) system for automatically replacing toner cartridges for supplying toner, no measure against the troubles of the toner cartridges is taken into consideration. That is, there is a risk of occurrence of a trouble during usage of toner cartridges: for example, 1) a toner cartridge will not rotate due to an electrical connection failure; 2) failure from a burnout of the motor for toner supply; and 3) toner builds up forming aggregations around the toner supply port so that no toner can be supplied. In such cases, it is impossible for the above-described conventional image forming apparatuses to prevent stoppage of the image forming operation once any of the aforementioned troubles with toner cartridges takes place.

SUMMARY OF THE INVENTION

The present invention has been devised in view of the above problems entailing the toner supply device provided for conventional image forming apparatuses, it is therefore an object of the present invention to provide a novel and improved toner supply device, developing device and image forming apparatus which, even if a trouble with a toner cartridge takes place, can deal with the trouble of the toner cartridge while continuing the image forming operation without cessation.

In order to solve the above problem, the first aspect of the present invention resides in a toner supply device for supplying toner to a developing device for developing an electrostatic latent image formed on an image bearer, comprising: a first toner supply portion for supplying toner to a developing hopper of the developing device; a second toner supply portion for supplying toner stored therein to the first toner supply portion; a first toner supply driver for driving the first toner supply portion when supplying the toner fed from the second toner supply portion to the developing device; a first residual toner quantity detector for detecting the residual quantity of toner stored in the first toner supply portion; a second toner supply driver for driving the second toner supply portion when supplying the toner stored in the second toner supply portion to the first toner supply portion; a second residual toner quantity detector for detecting the residual quantity of toner stored in the second toner supply portion; and, a controller for controlling the drives of the first and second toner supply drivers by switching on and off the drives of the first and second toner supply drivers in accordance with the residual toner quantities detected by the first and second residual toner quantity detectors.

Provision of the residual toner quantity detectors for detecting the residual quantity of the toner stored in the reserve tank as the first toner supply portion and for detecting the residual quantity of the toner stored in the toner cartridge as the second toner supply portion as described above, makes it possible to determine whether toner supply from the reserve tank and from the toner cartridge is correctly being done. Accordingly, the drive of the toner supply device can be controlled in accordance with the status of the toner supply operation of these toner supply portions, hence it is possible to suppress the lowering of printing efficiency of the image forming apparatus having the toner supply device of the invention.

The second aspect of the present invention resides in that in the above configuration, when, while both the first and second toner supply drivers are being driven, the controller detects that the residual quantity of toner in the first toner supply portion is equal to or lower than a predetermined level, by means of the first residual toner quantity detector, the controller controls the drives of the first and second toner supply drivers so as to keep driving the first toner supply driver and stop driving the second toner supply driver.

When the residual toner quantity in the reserve tank is not higher than the predetermined level despite the reserve tank and toner cartridge are driven in order to supply toner to the developing device, it can be determined that toner supply from the toner cartridge to the reserve tank is not being effected or that a trouble has occurred in the toner cartridge. Even if a trouble has occurred in the toner cartridge, the printing operation is enabled without cessation of image forming using the toner in the reserve tank, hence it is possible to reduce downtime without lowering printing efficiency.

The third aspect of the present invention resides in that in the above configuration, the second residual toner quantity detector includes non-volatile memory in which detected residual toner quantity information as the information as to the residual quantity of toner inside the second toner supply portion is stored.

This configuration enables easy grasp of the residual toner quantity in the toner cartridge, it hence is possible to realize early detection of a trouble occurring with the toner cartridge.

The fourth aspect of the present invention resides in that in the above configuration, the second residual toner quantity detector includes a first wireless transmitter/receiver for transmitting the detected residual toner quantity information stored in the non-volatile memory to the outside; and the controller includes a second wireless transmitter/receiver for receiving the detected residual toner quantity information transmitted from the first wireless transmitter/receiver and controls the second toner supply driver of the second toner supply portion in accordance with the detected residual toner quantity information obtained by the second wireless transmitter/receiver.

Since this configuration enables non-contact communication between the residual toner quantity detector and the controller, the residual toner quantity detector and the controller can be laid out at desired positions, hence making it possible to promote space-saving of the image forming apparatus.

The fifth aspect of the present invention resides in that the second toner supply portion includes a container for storing the toner and a rotational driver for rotationally driving the container; and the second toner supply driver is the rotational driver for rotationally driving the container, and the rotational driver rotationally drives the container to thereby supply toner to the first toner supply portion.

In this way, when the toner cartridge having, for example an approximately cylindrical shape is rotated about its axis so as to lead toner to the opening formed in the toner cartridge to thereby supply toner, the amount of toner supplied from the second toner supply portion to the opening by rotation is approximately constant, it is hence possible to supply a fixed amount of toner in a stable manner. Further, since rotation of the toner cartridge prevents toner from adhering to the interior wall of the toner cartridge, it is possible to prevent toner from being left over in the toner cartridge. Moreover, it is no longer necessary to arrange complicated agitators such as agitating rollers and the like inside the toner cartridge for preventing aggregation of toner.

The sixth aspect of the present invention resides in that in the above configuration, the second toner supply portion includes a revolution count detector for detecting the number of revolutions of the container and a residual quantity calculator for calculating the residual quantity of toner stored in the container from the total count of revolutions detected by the revolution count detector; and the residual toner quantity calculated by the residual quantity calculator is stored in the non-volatile memory as the detected residual toner quantity information.

Since this configuration makes it possible to calculate the amount of toner to be supplied from the toner cartridge, based on the total count of revolutions of the toner cartridge, detected by the revolution count detector and stored in the non-volatile memory as the detected residual toner quantity information, it is possible to easily detect the weight of the toner being held in the toner cartridge without providing a weight sensor or the like that detects the weight of the toner in the toner cartridge.

The seventh aspect of the present invention resides in that in the above configuration, the second toner supply portion includes a drive torque detector for detecting the drive torque of the rotational driver.

This configuration enables correction of the error of the aforementioned revolution count even if toner supply from the toner cartridge is unstable, hence it is possible to check the propriety of the residual toner quantity information as to the toner cartridge. As a result, it is possible to realize early detection of a trouble with the toner cartridge when no toner is supplied to the reserve tank despite that there remains toner inside the toner cartridge.

The eighth aspect of the present invention resides in that in the above configuration, the first residual toner quantity detector is an optical detector or piezoelectric detector.

This configuration facilitates detection of the residual quantity of toner in the reserve tank, hence enables early detection of an anomaly of toner supply from the toner cartridge.

The ninth aspect of the present invention resides in that the above configuration further includes a display portion for displaying an indication of a trouble occurring in the second toner supply portion when, while both the first and second toner supply drivers are being driven, the residual quantity of toner stored in the first toner supply portion is detected to be equal to or lower than a predetermined level by means of the first residual toner quantity detector.

In the above way, when a trouble has occurred with the toner cartridge, a message that informs the occurrence of a trouble with the toner cartridge is displayed so as to give a notice about the trouble to the user. Accordingly, it is possible for the user to solve the trouble smoothly.

The tenth aspect of the present invention resides in that the above configuration further includes an indicator for informing the number of printable pages when, while both the first and second toner supply drivers are being driven, the residual quantity of toner stored in the first toner supply portion is detected to be equal to or lower than a predetermined level by means of the first residual toner quantity detector.

In this way, when a trouble has occurred with the toner cartridge, a message, for example, "Though trouble has occurred approx 500 pages can be printed for A4 sized character originals" may be displayed on the monitor of the display portion in the image forming apparatus so as to inform the user of the approximate number of printable pages that is calculated based on the residual quantity of toner in the reserve tank. As a result, it is possible for the user to take immediate measures such as calling a service person before all the toner in the reserve tank is used up and hence minimize downtime of the printing operation of the image forming apparatus.

In order to solve the above problems, the eleventh aspect of the present invention resides in a developing device for forming a toner image on an image bearer by developing an electrostatic latent image formed on the image bearer, characterized in that toner is supplied from a toner supply device according to any one of the above aspects.

With this configuration, if trouble has occurred in the toner cartridge, formation of toner images on the photoreceptor as the image bearer can be continued using the toner from the reserve tank. In other words, the printing operation is enabled without cessation of image forming, it is hence possible to reduce downtime without lowering printing efficiency, even if trouble has occurred in the toner cartridge during toner supply.

In order to solve the above problems, the twelfth aspect of the present invention resides in an image forming apparatus including an image bearer for supporting an electrostatic latent image and a developing device according to the above aspect for visualizing the electrostatic latent image on the image bearer with toner.

With this configuration, if a trouble has occurred in the toner cartridge, the printing operation is enabled without cessation of image forming using the toner in the reserve tank, it is hence possible to prevent lowering of printing efficiency due to a trouble that has occurred in the toner cartridge.

As has been described heretofore, according to the present invention, it is possible for the residual toner quantity detectors arranged in the toner cartridge and in the reserve tank to which toner is supplied from the toner cartridge, to determine whether toner supply from the toner cartridge and that from the reserve tank are being correctly performed. Based on this determination, if a trouble having occurred in the toner cartridge is detected, toner supply control is made using the toner from the reserve tank. Accordingly, it is possible to continue the printing operation without cessation of the image forming operation, hence suppressing the lowering of printing efficiency.

BRIEF DESCRIPTION OF THE DRAWINGS

FIG. 8 is a chart showing criteria based on which the residual quantity of toner in a toner cartridge is determined in the same embodiment;

DESCRIPTION OF THE PREFERRED EMBODIMENTS

Figure 1:
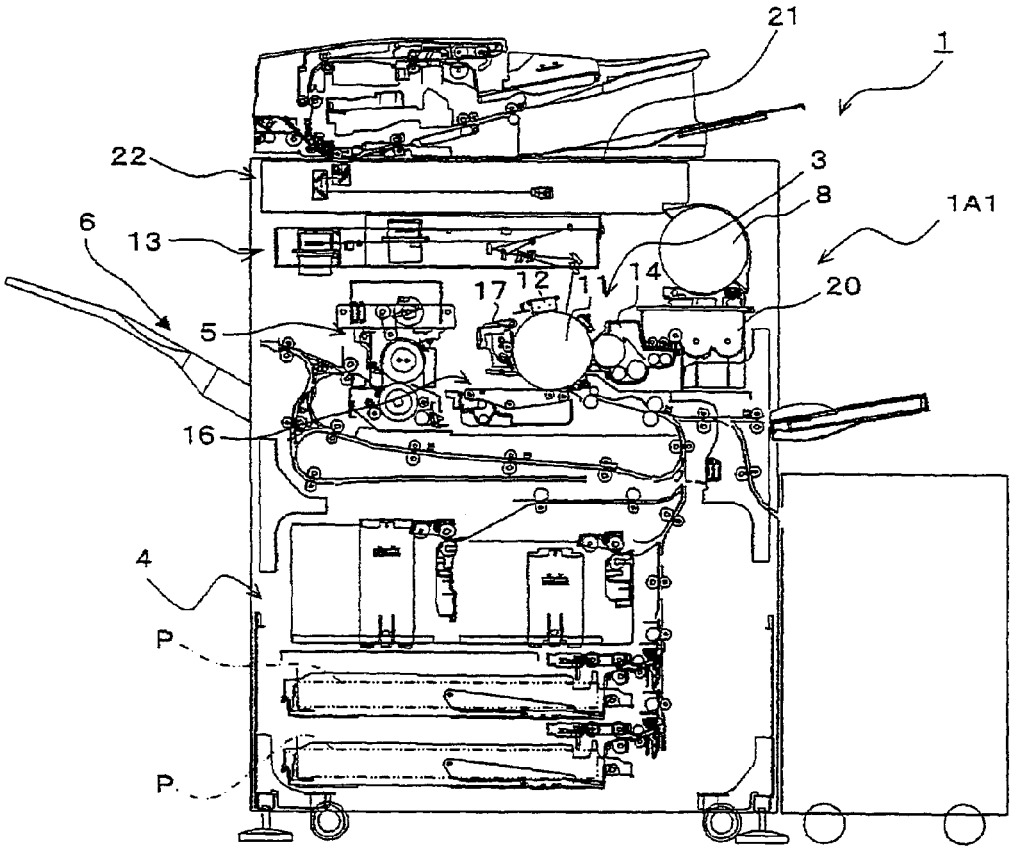
FIG. 1 is a view showing a configuration of an image forming apparatus of the first embodiment of the present invention.

A preferred embodiment of the present invention will hereinafter be described in detail with reference to the accompanying drawings. Here, in this description and drawings, the components having essentially the same functional configurations are allotted with the same reference numerals, so that repeated description is omitted.

Figure 2:
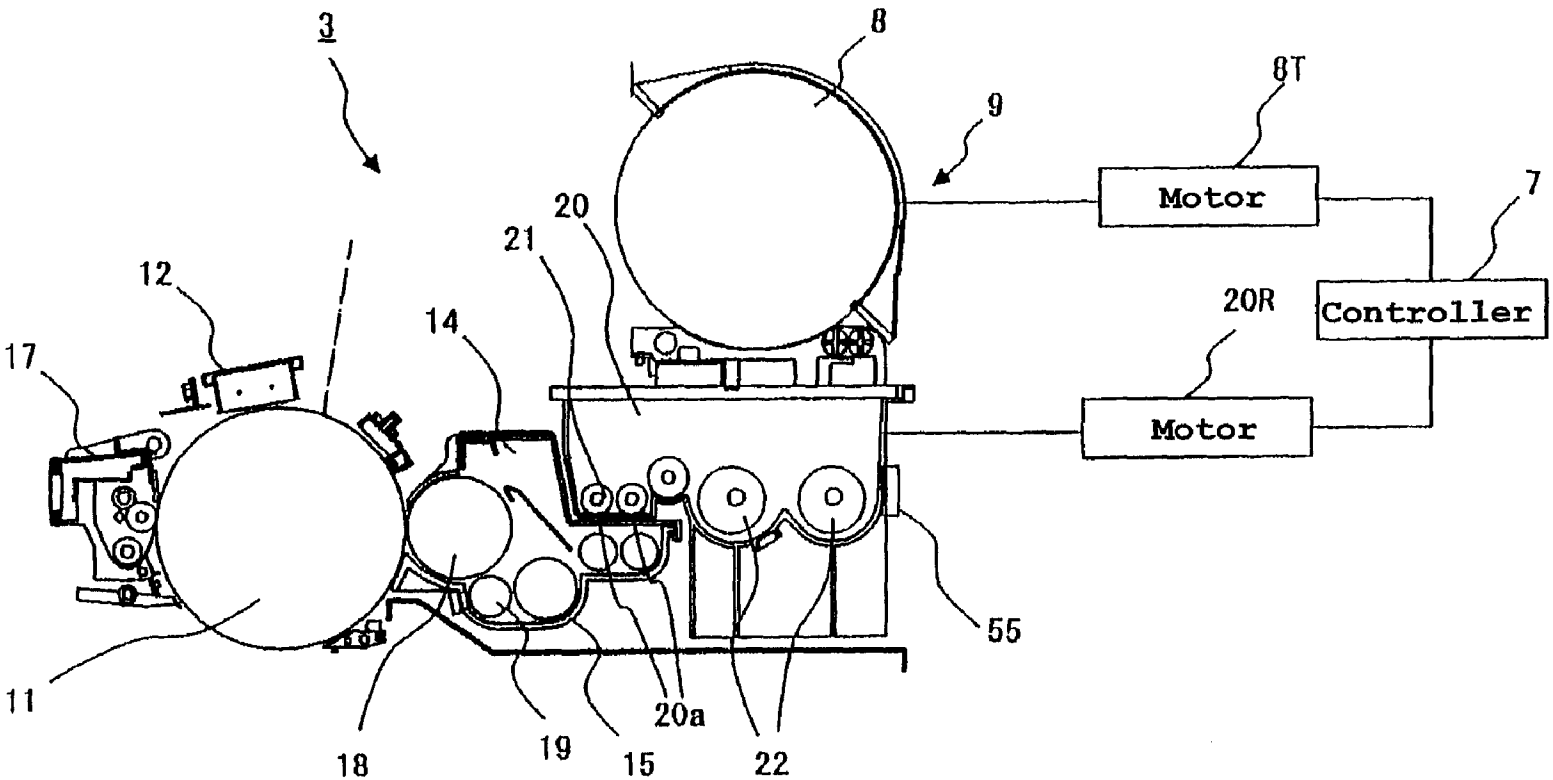
FIG. 2 is an enlarged view schematically showing a configuration around a developing device equipped in the image forming apparatus shown in FIG. 1.

To begin with, the configuration of the first embodiment of an image forming apparatus to which a toner supply device according to the present invention is applied will be described with reference to the drawings. FIG. 1 is a view showing a configuration of an image forming apparatus of the first embodiment of the present invention. FIG. 2 is an enlarged view schematically showing a configuration around a developing device equipped in the image forming apparatus shown in FIG. 1.

An image forming apparatus 1 of the present embodiment is an image forming apparatus using an electrophotographic image forming technique, e.g., a multi-functional machine having copier, printer and other functions. Image forming apparatus 1 essentially includes: an image information reader 2 for reading image information from documents; an unillustrated image processor for image processing the image information read by image information reader 2 or image information supplied from an external device such as a personal computer; an image forming portion 3 for forming images based on the image information output from the image processor; a paper feeder 4 for feeding recording paper to the image forming portion 3; a fixing unit 5 for fixing the image that was formed by image forming portion 3 and transferred to recording paper; a paper discharge portion 6 for discharging recording paper with images fixed thereon; and a controller 7 for controlling the entire operation of image forming apparatus 1.

Image information reader 2 has a function of reading image information of the original placed on an original table 10. Image information reader 2 is comprised of an unillustrated original scanning unit that reciprocates parallel along the undersurface of original table 10 and optical lenses and a CCD (charge coupled device) line sensor as a photoelectric transducer. Image information reader 2 reads the monochrome or color image of the original placed on original table 10 and outputs the image information of the read image to the image processor (not shown). The image processor converts the image information input from image information reader 2 or an external device such as a personal computer etc., into electric signals for colors and outputs them to an exposure unit 13 in image forming portion 3.

Image forming portion 3 has a photoreceptor 11 as an image bearer on which an electrostatic latent image is formed, and further includes: a charger 12 for uniformly electrifying the photoreceptor 11; an exposure unit 13 for illuminating the electrified photoreceptor 11 surface with light in accordance with the image information output from the image processor to form an electrostatic latent image; a developing unit 14 for forming a toner image on the photoreceptor 11 surface with the toner stored in a developing hopper 15; a transfer portion 16 for transferring the toner image formed on the photoreceptor 11 surface by developing unit 14 to recording paper; and a cleaning unit 17 for cleaning the photoreceptor 11 surface after transfer of the toner image at transfer portion 16, all being arranged around photoreceptor 11.

Exposure unit 13 is an optical unit (LSU: laser scanning unit) including a semiconductor laser device for emitting a laser beam forming a spot of light that is modulated in accordance with the pixel signal input from the image processor and mirrors for conducting the light emitted from the semiconductor laser device to photoreceptor drums 11 for different colors.

Developing unit (developing device) 14 has a function of developing the electrostatic latent image formed by exposure unit 13 on the surface of the image bearer or photoreceptor 11 into a visual toner image. As shown in FIG. 2, developing unit 14 includes: a developing roller 18 arranged opposing photoreceptor 11 for supplying toner to the electrostatic latent image on the photoreceptor 11 surface; an agitating roller 19 for agitating and conveying the developer to developing roller 18; a developing hopper 15 having developing roller 18 and agitating roller 19 and these two rollers 18 and 19 being rotatably mounted therein; a reserve tank 20 as a container that is connected to developing hopper 15 by a supply port 20*a* to supply toner to developing hopper 15; and a toner cartridge 8 for supplying toner to developing hopper 15 via reserve tank 20. Here, reserve tank 20 and toner cartridge 8 mounted thereto form a toner supply device 9 serving as a toner supply portion. This toner supply device 9 constitutes the toner supply device of the present embodiment.

Developing hopper 15 is a container for storing toner, formed of a hard synthetic resin etc., for example. Arranged inside or near developing hopper 15 is an unillustrated toner concentration sensor for detecting the toner concentration inside developing hopper 15. The measurement of toner concentration by the toner concentration sensor is output to controller 7.

Reserve tank 20 has a function as a first toner supply portion for supplying toner to developing hopper 15 of developing device 14, and includes: a toner supply roller 21 arranged directly above hopper supply port 20*a* for feeding toner from the reserve tank 20 to developing hopper 15; toner supply rotors 22 for supplying toner to toner supply roller 21; and a residual toner quantity detection sensor 55 as the first toner residual quantity detector for detecting the residual quantity of the toner stored in reserve tank 20. In order to enable easy detection of the residual toner quantity in the reserve tank and early detection of an anomaly of toner supply from toner cartridge 8 or other troubles, the present embodiment may employ an optical type detection sensor or a piezoelectric type detection sensor as residual toner quantity detection sensor 55. Toner supply roller 21 and toner supply rotors 22 to be driven when toner is supplied to developing hopper 15 of developing unit 14 are driven by a motor 20R as the first toner supply driver.

The toner to be supplied to developing hopper 15 is stored in toner cartridge 8 that is removably mounted to reserve tank 20 of toner supply device 9 in image forming portion 3 of image forming apparatus 1. Toner cartridge 8 has a function as the second toner supply portion for supplying toner stored therein into reserve tank 20, and has an approximately cylindrical shape and is coupled to a motor 8T as a rotational driver for rotating toner cartridge 8 about its rotational axis. This motor 8T has the function as the second toner supply driver for driving toner cartridge 8 as the second toner supply portion when toner stored in toner cartridge 8 is supplied to reserve tank 20, and rotates toner cartridge 8 to thereby supply toner to reserve tank 20. Toner cartridge 8 also includes a wireless IC tag 27 (see FIG. 4) as the second residual toner quantity detector for detecting the residual quantity of the toner held therein.

In image forming apparatus 1 of the present embodiment, controller 7 has the function of detecting whether toner is correctly supplied from toner cartridge 8 to reserve tank 20, through the residual toner quantity detectors for detecting the quantities of residual toner stored respectively in toner cartridge 8 and reserve tank 20, when toner is supplied from toner cartridge 8 for storing toner to reserve tank 20 and from reserve tank 20 to developing hopper 15. As a characteristic feature, in order to stop the operation of motor 8T for toner cartridge 8 and continue toner supply from reserve tank 20 to developing hopper 15 once trouble such as a toner supply anomaly or the like has occurred in toner cartridge 8, the controller is adapted to make on/off control of the drive of motor 20R as the first toner supply driver for supplying toner from reserve tank 20 to developing hopper 15 and on/off control of the drive of motor 8T as the second toner supply driver for supplying toner from toner cartridge 8 to reserve tank 2. The detail of the operation and control of the toner supply device comprised of reserve tank 20 having the function of the first toner supply portion and toner cartridge 8 having the function of the second toner supply portion in the present embodiment will be described later.

Figure 3B:
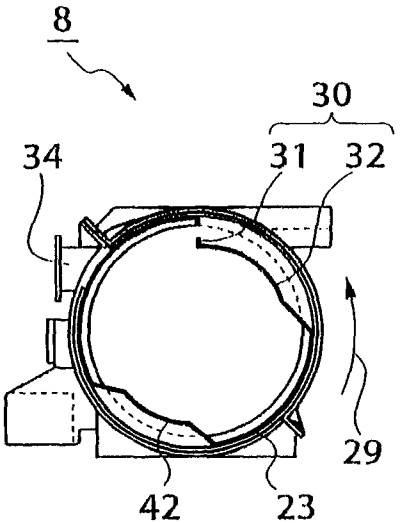
FIG. 3 is a schematic view showing a configuration of a toner cartridge of the same embodiment, FIGS. 3A and 3B being front and sectional views, respectively.
Figure 3A:
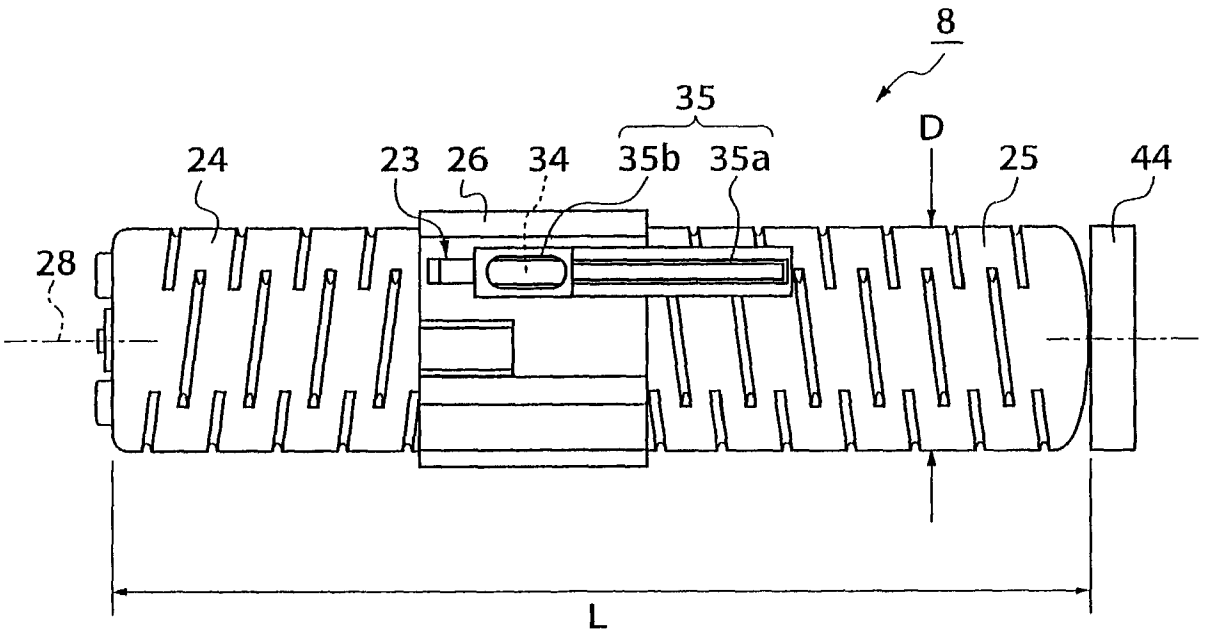
Figure 4:
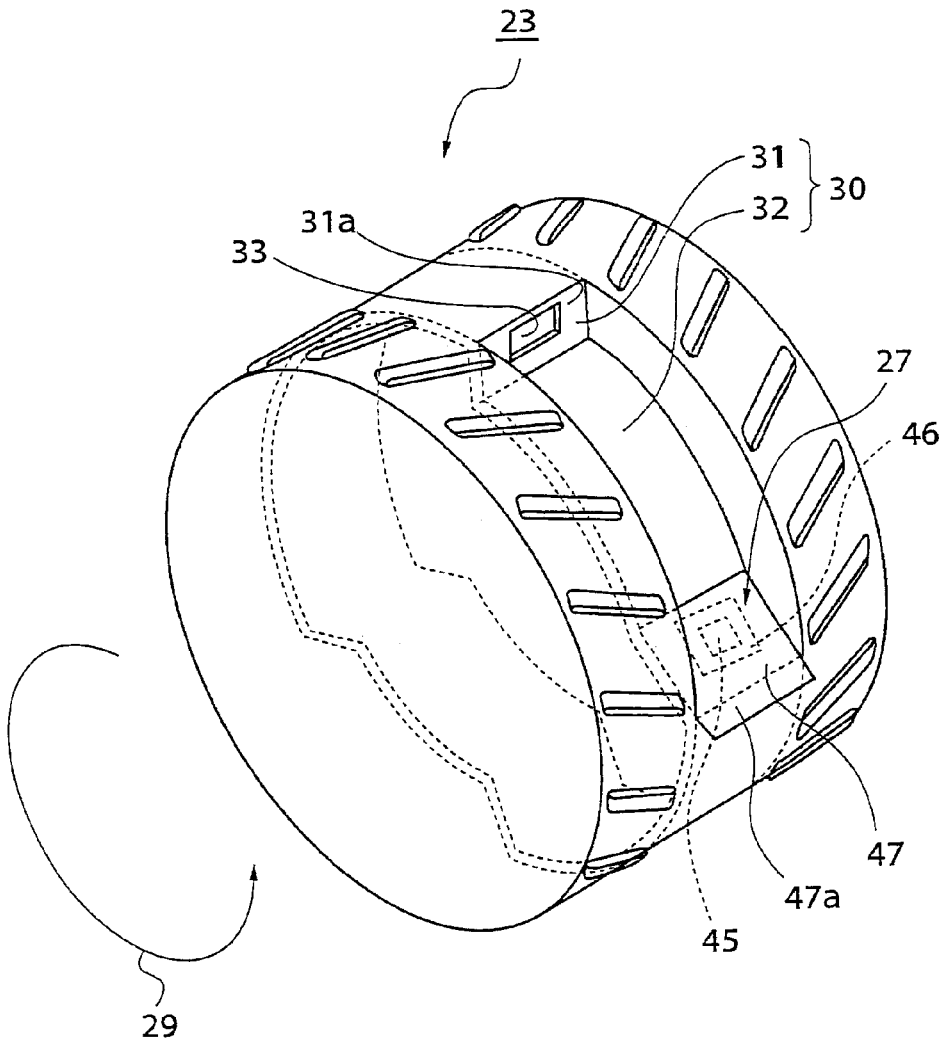
FIG. 4 is a perspective view showing a middle container part of the toner cartridge shown in FIG. 3.

Next, the configuration of the toner cartridge provided for the toner supply device according to the first embodiment of the present invention will be described with reference to the drawings. FIG. 3 is a view schematically showing a configuration of a toner cartridge of the present embodiment, FIGS. 3A and 3B being front and sectional views, respectively. FIG. 4 is a perspective view showing a middle container part of the toner cartridge shown in FIG. 3.

Toner cartridge 8 is formed of, for example a hard synthetic resin or the like and roughly has a cylindrical shape with bases with its sectional shape perpendicular to its rotational axis 28 having no corner or defined by a curved line. As an example of the external dimensions of toner cartridge 8, the toner cartridge has a diameter D of 180 mm and a length L of 450 mm with a toner storing capacity of 4,000 $cm^3$.

As shown in FIG. 3A, toner cartridge 8 is comprised of a middle container part 23 arranged in the approximate center with respect to length (L), first and second container parts 24 and 25 mounted to, and extending sidewards from, both sides of the middle container part 23, and a supporting structure 26 provided so as to cover the periphery of middle container part 23. As shown in FIG. 4, in each toner cartridge 8 a wireless IC tag 27 as a residual toner quantity detector (the second residual toner quantity detector) for detecting the residual quantity of the toner stored in toner cartridge 8 is arranged in middle container part 23. This toner cartridge 8 is rotationally driven about rotational axis 28 in the direction of an arrow 29 by motor 8T as a rotational driver.

Attached to one end of toner cartridge 8 or at the bottom of second container part 25 is a revolution count detector 44 as shown in FIG. 3A. This revolution count detector 44 counts the number of times the container part of toner cartridge 8 has rotated. Revolution count detector 44 includes a publicly known revolution counter that produces a signal output every revolution and a transmitter for transmitting the signal output to wireless IC tag 27 as the residual toner quantity detector for detecting the residual quantity of the toner stored in toner cartridge 8. Hereinbelow, this revolution count detector 44 will be called simply as revolution counter 44.

Wireless IC tag 27 is provided for toner cartridge 8, and is comprised of, as shown in FIG. 4, an IC chip portion 45 as a non-volatile memory in which the detected residual toner quantity information as the information on the residual quantity of the toner held inside toner cartridge 8, an antenna portion 46 as the first wireless transceiver/receiver for transmitting the detected residual toner quantity information stored in IC chip portion 45 to the outside and a base film 47 to which IC chip portion 45 and antenna portion 46 are attached. In the present embodiment, wireless IC tag 27 as the residual toner quantity detector is provided on middle container part 23.

Base film 47 is a film sheet made of polyester or the like, for instance. This base film 47 is attached to a sloping portion 32 of middle container part 23 with its one end slightly projected over the outer periphery of middle container part 23. Projected part 47*a* of the base film from slope 32 functions as a scraper that collects the toner that was discharged from a toner discharge port 33 and conveyed in sloping portion 32 to the vicinity of the outer peripheral surface of middle container part 23 and sends it into a toner conduit 34.

Antenna portion 46 is a communicator that exchanges data with revolution counter 44 and transmits the detected residual toner quantity information stored in IC chip portion 45 to a communication device 48 (see FIG. 7) as the second wireless transmitter/receiver included in controller 7.

IC chip portion 45 is a storage as a main part of wireless IC tag 27. This IC chip portion 45 can be stored with ID information for identifying the type of toner cartridge 8 and the detected residual toner quantity information as to the residual toner quantity detected by revolution counter 44.

Here, the ID information for identifying the type of toner cartridge B is a piece of information that shows whether the toner contained in toner cartridge 8 is suitable for the current image forming apparatus or whether the toner is not for the other kinds of apparatus. This ID information is input to IC chip portion 45 by a dedicated input device when the toner cartridge is produced and filled with toner.

The detected residual toner quantity information is stored as the total count of revolutions that have been detected by revolution counter 44. Since a predetermined amount of toner is dispensed every time the container portion of toner cartridge 8 makes one revolution as described above, it is possible to obtain the information about the total amount of toner discharged, from the total count of revolutions. The detected information of the revolution count on revolution counter 44 is supplied in real time via antenna portion 46 of wireless IC tag 27 to rewrite IC chip portion 45 while image forming apparatus 1 is being operated. In addition to the aforementioned information, it is also possible to store the number of printout recording sheets, process conditions, development conditions and other information in wireless IC tag 27.

Either of the first and second container parts 24 and 25 is a cylindrical container having a base and an opening on the other side. These container parts are joined to middle container part 23 in such a manner that the interior spaces of first and second container parts 24 and 25 communicate with the interior space of middle container part 23 via the openings. Middle container part 23 has an approximately cylindrical shape, having a depressed portion 30 with a slope, positioned at the approximate center with respect to the length direction and extended along about one-fourth of the circumference, as shown in FIG. 3B.

Depressed portion 30 is defined by a stepped portion 31 that is formed by being intended in the radial direction of middle container part 23 and sloping portion 32 that is formed so that its depth becomes shallower from the downstream side to the upstream side with respect to the rotational direction, indicated by 29, of toner cartridge 8. As shown in FIG. 4, opening 33 that leads to the interior space of middle container part 23 is formed in stepped portion 31, specifically, the portion, designated at 31*a*, that falls radially downwards. In the present embodiment, since toner stored in toner cartridge 8 is discharged through this opening 33 as toner cartridge 8 is rotated in the direction of arrow 29, the opening is called toner discharge port 33.

Supporting structure 26 that is provided so as to cover middle container part 23 is a structure that rotatably supports middle container part 23, first and second container parts 24 and 25 of toner cartridge 8 which is rotated by motor 8T. Supporting structure 26 has conduit 34 that leads to the outer peripheral surface of middle container part 23 and is formed at the position corresponding to depressed portion 30 of middle container part 23. This conduit 34 is formed with a shutter member 35 for opening and closing it as necessary. Shutter member 35 is comprised of a guide element 35*a* provided in the longitudinal direction of toner cartridge 8, a lid element 35*b* that is slidable in the longitudinal direction of toner cartridge 8 being guided by guide element 35*a* so as to open and close conduit 34, and an unillustrated driver for sliding lid element 35*b*.

Conduit 34 of supporting structure 26 is constructed so as to be connected to developing hopper 15 of developing unit 14 by way of a communication duct and reserve tank 20. Accordingly, when the container portion of toner cartridge 8 rotates in the direction of arrow 29, a predetermined amount of toner is discharged from toner cartridge 8 through toner discharge port 33, and the discharged toner is conveyed through sloping portion 32 to the outer peripheral surface of middle container part 23. The thus conveyed toner is supplied to developing hopper 15 through conduit 34 which is opened and reserve tank 20.

Figure 5A:
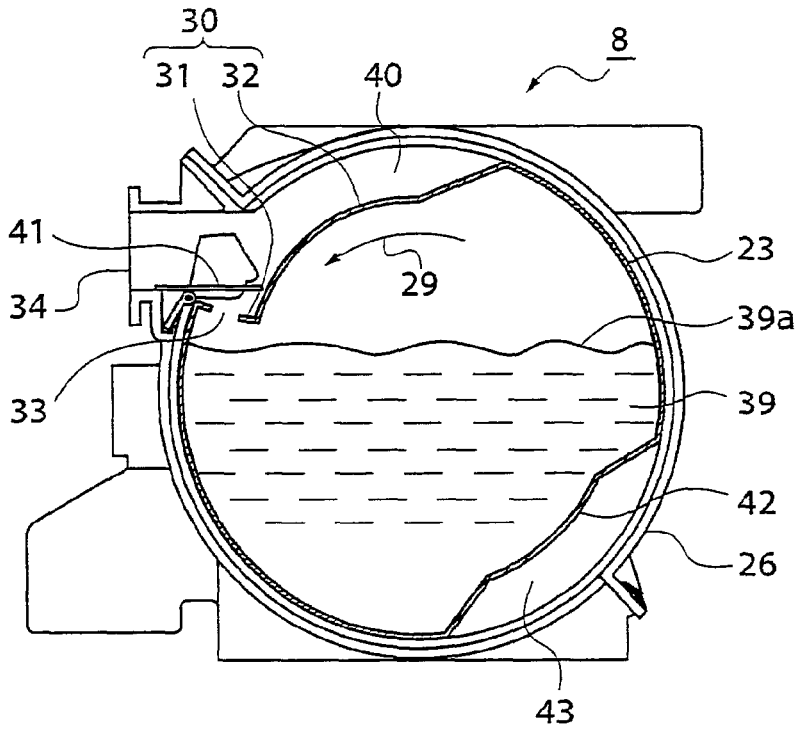
FIGS. 5A and 5B are sectional views showing the outline of how the toner cartridge provided for the toner supply device according to the same embodiment supplies toner to the developing unit.
Figure 5B:
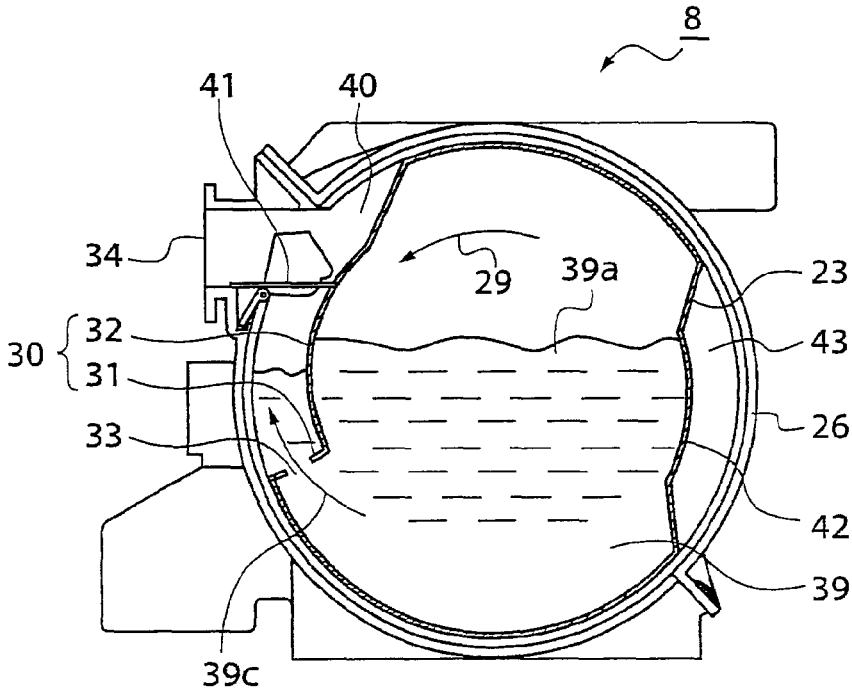
Figure 6A:
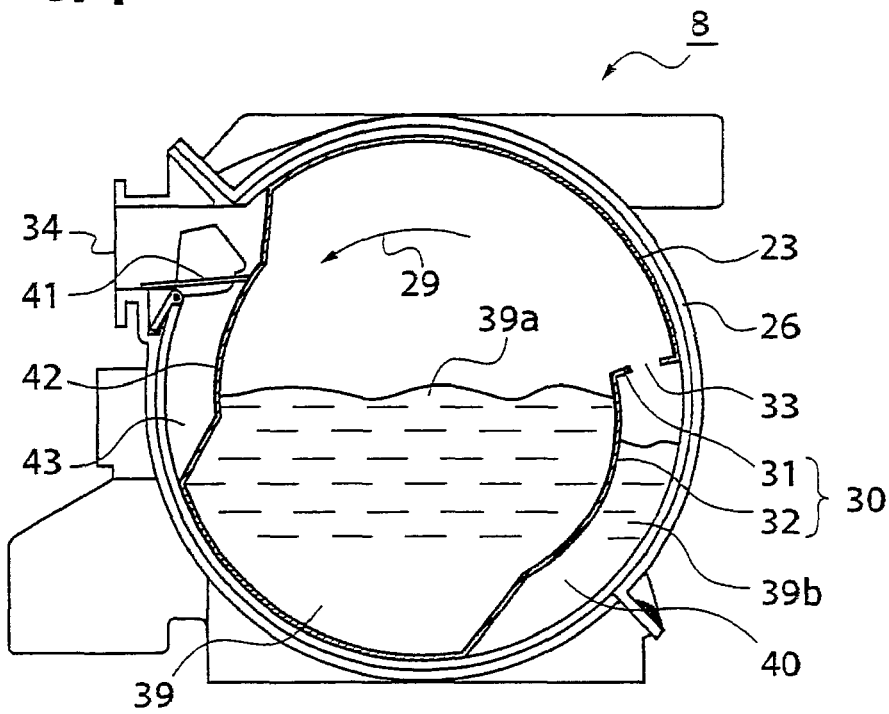
FIGS. 6A and 6B are sectional view showing the outline of how the toner cartridge provided for the toner supply device according to the same embodiment supplies toner to the developing unit.
Figure 6B:
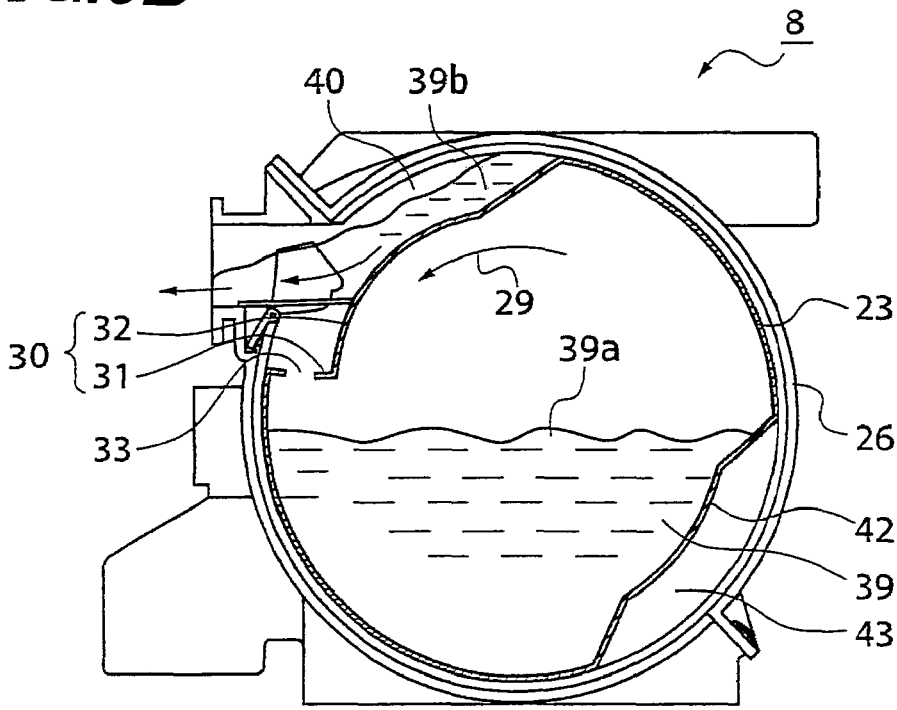

Next, how the toner cartridge, arranged in the toner supply device of the present embodiment, supplies a predetermined amount of toner into the reserve tank will be further described with reference to the drawing. FIGS. 5 and 6 are sectional views showing the outline of how the toner cartridge provided for the toner supply device according to the present embodiment supplies toner to the developing unit. Here, in these drawings, FIGS. 5A, 5B, 6A and 6B show the sections of the toner cartridge being rotationally driven to supply toner, in sequential order.

In FIG. 5A, toner cartridge 8 is set at such a rotational position that depressed portion 30 and toner discharge port 33 formed in middle container part 23 are positioned above the top surface designated at 39*a* (which will be referred to hereinbelow as toner layer surface 39*a*) of the toner held in middle container part 23. When middle container part 23 of toner cartridge 8 is rotated in the direction of arrow 29 about rotational axis 28 (FIG. 3A) by motor 8T, and toner discharge port 33 comes to be positioned below toner layer surface 39*a* as shown in FIG. 5B, toner 39 moves from middle container part 23 into depressed portion 30 through toner discharge port 33 as shown in an arrow 39*c*.

As toner cartridge 8 is further rotated in the direction of arrow 29, toner discharge port 33 comes to be positioned above toner layer surface 39*a* as shown in FIG. 6A, so that delivery of toner 39 to depressed portion 30 through toner discharge port 33 stops and a predetermined amount of toner 39*b* is held in a space 40 that is formed by depressed portion 30 of middle container part 23 and the inner wall of supporting structure 26. In this way, a predetermined amount, e.g., 6 grams of toner 39*b* is held in space 40.

As toner cartridge 8 is rotated in the direction of arrow 29 from the state shown in FIG. 6A, toner 39*b* held in space 40 is guided to conduit 34 by a guide member 41 that is arranged so as to elastically abut and slide along the outer peripheral surface of middle container part 23, as shown in FIG. 6B. During this, since guide member 41 abuts and slides along the outer peripheral surface of middle container part 23, almost all toner 39*b* held in depressed portion 30 can be brought into conduit 34. Toner 39*b* thus conveyed into conduit 34 is supplied to developing hopper 15 of developing unit 14 by way of reserve tank 20. In this way, a predetermined amount of toner 39 can be delivered from toner cartridge 8 to reserve tank 20 every time toner cartridge 8 makes one revolution.

Middle container part 23 also has another depressed portion 42 (FIG. 5A) located on the opposite side from depressed portion 30 about rotational axis 28 (FIG. 3A). Accordingly, a second space 43 is created between this second depressed portion 42 and the inner wall of supporting structure 26. The second space 43 is formed aiming at holding the developer leakage if toner 39*b* held in space 40 has leaked out from the upstream side of space 40 with respect to the rotational direction indicated by arrow 29. Similarly to toner 39*b* held in space 40, the developer held in this second space 43 is also guided to conduit 34 by guide member 41 that is arranged so as to elastically abut and slide along the outer peripheral surface of middle container part 23 as middle container part 23 rotates in the direction of arrow 29. In this way, even if toner 39*b* leaks out from space 40, toner 39*b* that leaked out is once again collected by space 43 and then guided by guide member 41 to conduit 34. Accordingly, it is possible to positively supply the aforementioned predetermined amount of toner to developing unit 14.

Further, when toner cartridge 8 is formed such that its section perpendicular to rotational axis 28 is not formed with angular corners but formed with curved corners as already described, the interior space is also formed without angular corners. Accordingly, toner can be discharged smoothly as the toner cartridge rotates so that it is difficult for toner to remain in the interior space. Further, when the toner cartridge with its residual toner used up to the lower limit is removed from the apparatus body, the interior of the toner cartridge can be easily cleaned and hence the residual toner can be to a large extent completely removed. This facilitates reuse of toner cartridge 8. In the present invention, a toner cartridge 8 having a shape other than the aforementioned approximate cylinder with a base may be used.

Further, as described above, in the present embodiment, motor 8T as the toner supply driver for supplying toner from toner cartridge 8 to reserve tank 20 (FIG. 2) or the rotational driver for rotating toner cartridge 8 to supply toner, and motor 20 R as the toner supply driver for supplying toner from reserve tank 20 to developing hopper 15 or the rotational driver for supplying toner, are controlled by controller 7. This controller 7 starts rotating motor 20 R so as to supply toner from reserve tank 20 when the measurement of the toner concentration in developing hopper 15, output from an unillustrated toner concentration sensor arranged inside or near developing hopper 15 becomes lower than a predetermined level.

When the residual toner quantity detector inside reserve tank 20, namely residual toner quantity detection sensor 55 such as an optical type detection sensor, or a piezoelectric type detection sensor, detects a status of a lower proportion of toner in the reserve tank, the controller starts rotating motor 8T so as to supply toner from toner cartridge 8. Here, the predetermined level of toner concentration means a value that is greater than the lowest toner concentration above which fine image density can be obtained, and can be determined as appropriate.

Here, if a case occurs in which toner fails to be supplied into reserve tank 20 and the residual toner quantity in reserve tank 20 becomes lower despite that there remains toner inside toner cartridge 8, it is strongly suspected that some trouble has occurred with toner cartridge 8. That is, there is a risk of occurrence of trouble during usage of toner cartridges: 1) a toner cartridge will not rotate due to an electrical connection failure; 2) failure from a burnout of the motor for toner supply; and 3) toner builds up forming aggregations around the toner supply port so that no toner can be supplied. If such a case happens in the present embodiment, the operations of motors 8T and 20R as the toner supply drivers are controlled so that motor 20R for reserve tank 20 alone is operated to supply toner to developing hopper 15 while the operation of motor 8T for toner cartridge 8 is stopped.

Figure 7:
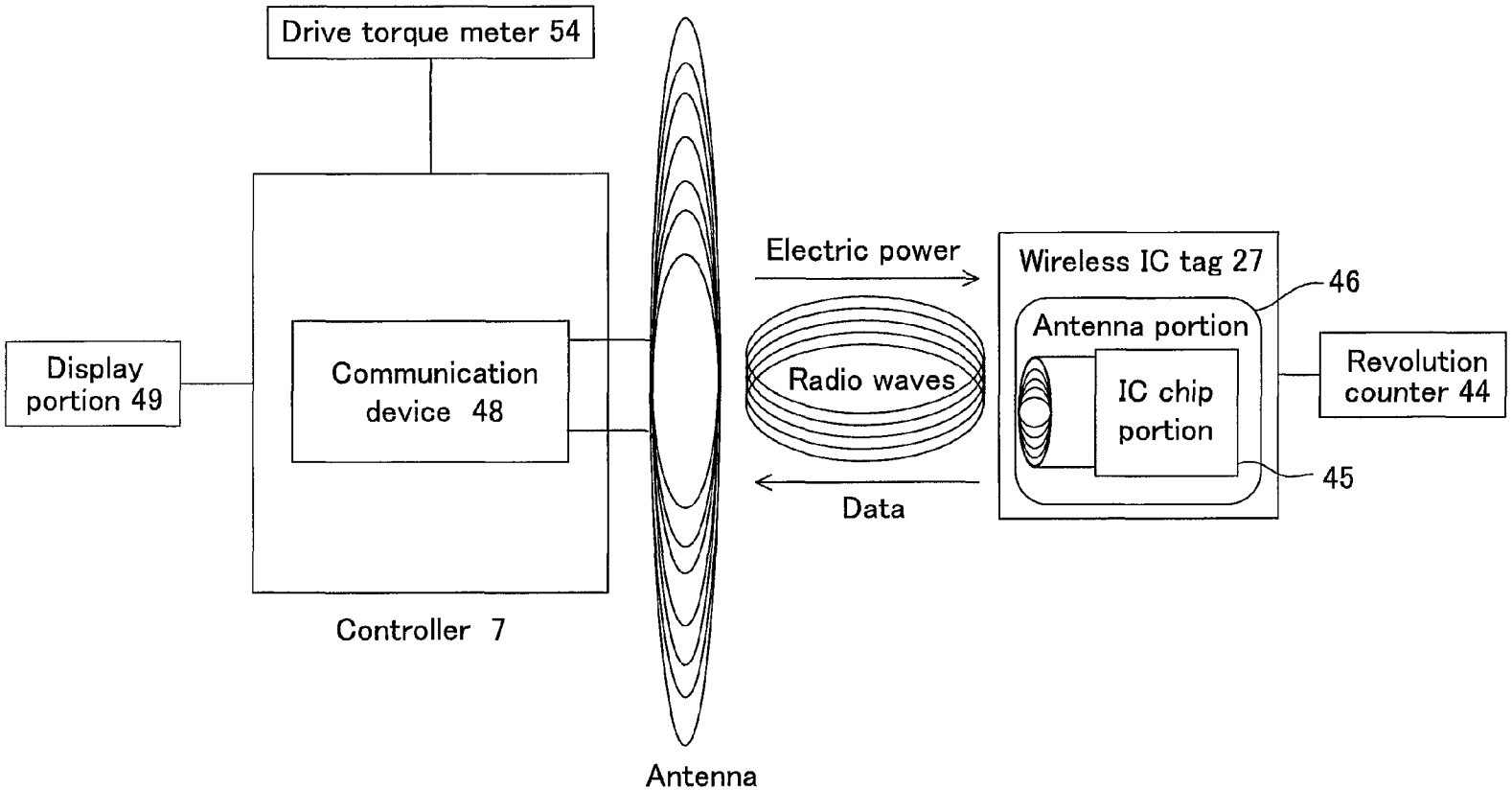
FIG. 7 is a block diagram showing an electric configuration related to the operation of the controller of the toner supply device of the same embodiment.

Now, the electric configuration of controller 7 that computes the residual toner quantities in toner cartridge 8 and reserve tank 20 in the toner supply device of the present embodiment will be described with reference to the drawings. FIG. 7 is a block diagram showing an electric configuration for the operation of the controller of the toner supply device of the present embodiment.

In the present embodiment, as shown in FIG. 7, controller 7 includes a communication device 48 as the second wireless transmitter/receiver for receiving the detected residual toner quantity information transmitted from wireless IC tag 27. The detected output of the revolution count from revolution counter 44 is given to IC chip portion 45 from the communicator of revolution counter 44 via antenna portion 46 of wireless IC tag 27 and stored as the total count of revolutions, as mentioned above.

In this arrangement, when it is detected by the toner concentration detecting sensor that the toner concentration in developing hopper 15 is lower than the predetermined toner concentration, controller 7 sends a signal to motor 20R of reserve tank 20 so that the motor will supply toner from reserve tank 20 to developing hopper 15. At the same time, controller 7 sends a signal to motor 8T of toner cartridge 8 so that the motor will supply the used amount of toner based on the detected result of residual toner quantity detection sensor 55 provided inside reserve tank 20.

Next, communication device 48 sends a signal that requests antenna portion 46 of wireless IC tag 27 provided for toner cartridge 8 to send (return) the detected residual toner quantity information as to the residual amount of toner in toner cartridge 8. When antenna portion 46 of wireless IC tag 27 provided for toner cartridge 8 receives this request signal it sends (returns) the total count of revolutions read out as the detected residual toner quantity information to communication device 48 of controller 7.

Controller 7 includes an unillustrated storage, in which the initial value of the amount of toner stored when toner cartridge 8 was manufactured and the amount of toner to be discharged per one revolution of toner cartridge 8 have been stored beforehand. Controller 7, based on these previously stored data in this storage and the total count of revolutions received by communication device 48, computes the following formula shown in Eq. (1) to obtain the residual quantity of the toner being held in toner cartridge 8.

(Residual toner quantity)=(Initial toner quantity)−(Amount of toner to be discharged per one revolution)×(Total count of revolutions) Eq.(1)

When the residual toner quantity obtained from Eq. (1) falls below the lowest limit that has been stored beforehand in the storage, or when the toner cartridge has no usable quantity of toner or is empty, controller 7 displays an indication that the toner cartridge 8 should be replaced by a new one on a display portion, e.g., display portion 49, provided for image forming apparatus 1. In accordance with this display, the operator of image forming apparatus 1 carries out a replacement work of toner cartridge 8.

Since, in the present embodiment, the amount of toner to be supplied from toner cartridge 8 is calculated in the above way, based on the total count of revolutions of toner cartridge 8, detected by revolution counter 44 and stored in the non-volatile memory as the detected residual toner quantity information, it is possible to easily detect the weight of the toner being held in toner cartridge 8 without providing a weight sensor or the like that detects the weight of the toner in toner cartridge 8.

Controller 7, as having obtained the detected residual toner quantity information in the above way, controls motors 8T and 20R when the toner concentration in developing hopper 15 falls below the predetermined level. Since wireless IC tag 27 and controller 7 are used to establish a non-contact communication with each other so as to control motor 8T of toner cartridge 8 in accordance with the detected residual toner quantity information obtained at communication device 48, wireless IC tag 27 and controller 7 can be arranged at desired positions, hence this feature will contribute to space-saving of image forming apparatus 1.

Further, the present embodiment includes a drive torque meter (FIG. 7) for measuring the drive torque of motor 8T as the rotational driver in order to determine the propriety of the residual toner quantity information by correcting the error of the aforementioned revolution count to thereby correct the error of the residual toner quantity in toner cartridge 8 even if toner supply from toner cartridge 8 is unstable. As a result, it is possible to realize early detection of a trouble with toner cartridge 8 when no toner is supplied from toner cartridge 8 to reserve tank 20 despite that there remains toner inside toner cartridge 8.

Now, FIG. 8 shows criteria for residual toner quantity. If the total revolution count of toner motor 8T is equal to or greater than a certain fixed value (the value with which the residual toner quantity inside toner cartridge 8 is calculated to be equal to 0% from the above Eq. (1)) and the drive torque has a reasonable value corresponding to the situation, the toner quantity is regarded as 0%. If the drive torque value is in anomaly, the residual toner quantity determined by Eq. (1) can be determined to be incorrect.

Similarly, if the total revolution count of toner motor 8T has not reached a certain fixed value (the value with which the residual toner quantity inside toner cartridge 8 is calculated to be equal to 0% from the above Eq. (1)) and the drive torque has a reasonable value corresponding to the situation, the toner quantity is regarded as being suitable. In contrast, if the drive torque value is in anomaly, the residual toner quantity determined by Eq. (1) can be determined to be incorrect. In this case, for example, the aforementioned reasonable drive torque corresponding to the situation is about 1.08 Nm (11 kgfcm) when toner remains in toner cartridge 8) and it is about 0.49 Nm (5 kgfcm) when toner cartridge 8 contains no toner.

Figure 9:
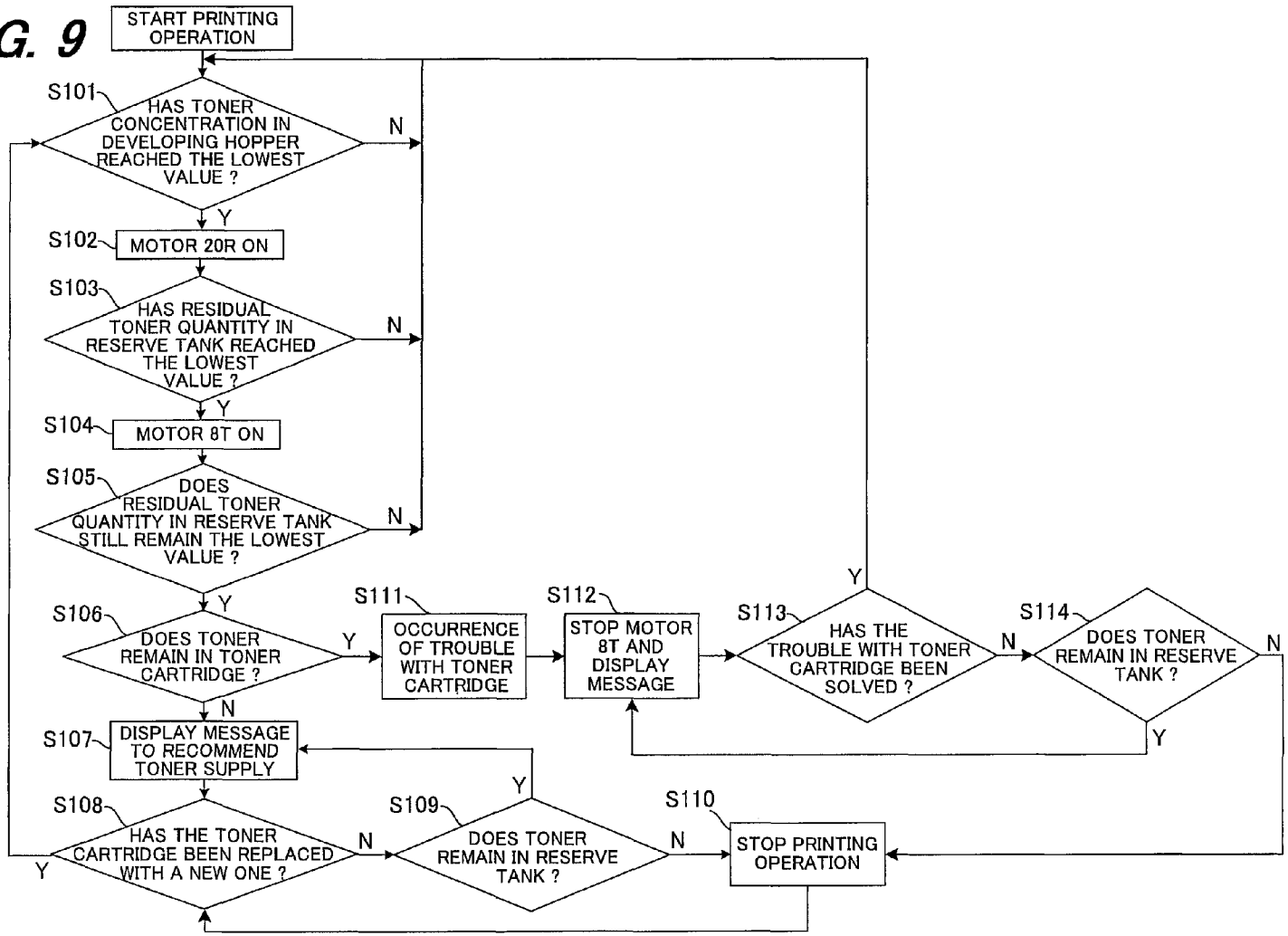
FIG. 9 is a flow chart showing a printing operation flow in an image forming apparatus equipped with the toner supply device in the same embodiment; and, FIG. 10 is a view showing an example of a message that is displayed when a trouble has occurred in the toner cartridge in the same embodiment.

Next, the image forming operation (printing operation) in the image forming apparatus having the toner supply device of the present embodiment will be described with reference to the drawings. FIG. 9 is a flow chart showing a flow of printing operation in an image forming apparatus equipped with the toner supply device in the same embodiment.

After start of a printing operation, in the process of the image forming operation stated above, controller 7 determines whether the measurement of toner concentration by the toner concentration sensor provided in developing hopper 15 of developing device 14 has reached the lowest value of toner concentration, which is the minimum necessary value for an printing operation (Step S101).

When controller 7 detects that the toner concentration in developing hopper 15 has reached the lowest value, or when the toner concentration in developing hopper 15 has decreased (to the toner Low level), controller 7 starts rotating motor 20R as the driver of reserve tank 20 so as to supply toner to developing hopper 15 (Step S102).

Subsequently, the residual toner quantity in reserve tank 20 is determined by residual toner quantity detection sensor 55 provided therein (Step S103). If the residual toner quantity in reserve tank 20 is low, or if it is detected that the toner quantity has reached the lowest value, which is the minimum necessary value to continue an printing operation, controller 7 starts rotating motor 8T as the driver of toner cartridge 8 so as to supply toner to reserve tank 20 (Step S104).

Thereafter, the residual toner quantity in reserve tank 20 is detected by residual toner quantity detection sensor 55 so as to determine if the residual toner quantity in reserve tank 20 still remains the lowest value, which is the minimum necessary value to continue an printing operation (Step S105).

If it is detected at Step S105 that the output from residual toner quantity detection sensor 55 of reserve tank 20 remains at the lowest value (Low) (including the cases where the detected value is lower than the lowest value and where the detected value remains approximately unvaried), then the residual toner quantity in toner cartridge 8 is checked in the aforementioned manner by controller 7 which obtains the detected residual toner quantity information (Step S106).

As a result from this Step S106, when the residual toner quantity in toner cartridge 8 is 0%, or the toner is used up, a message "Please change the toner cartridge for a new one" is displayed (Step S107). Then, it is determined whether the current toner cartridge 8 has been replaced with a new one (Step S108).

At this stage, if the toner cartridge 8 has not been replaced yet, it is then determined whether toner remains in reserve tank 20 (Step S109). If there is toner remaining in reserve tank 20, the printing operation of image forming apparatus 1 is permitted until the toner in reserve tank 20 is used up. On the other hand, if no toner remains in reserve tank 20, the printing operation of image forming apparatus 1 is disabled, so that the printing operation is ended (Step S110).

At Step S108, if the current toner cartridge 8 has been replaced with a new toner cartridge 8, toner is supplied to reserve tank 20 to the specified level as a manner of course, and the normal printing operation is recovered.

On the other hand, as a result from Step S106, when it is determined by checking the residual toner quantity in toner cartridge 8 that toner still remains in toner cartridge 8, it is determined that some trouble with toner cartridge 8 has occurred (Step S111), and the operation of motor 8T as the toner supply driver of toner cartridge 8 is stopped (Step S112) while motor 20R as the toner supply driver of reserve tank 20 is operated alone. That is, the printing operation of image forming apparatus 1 is continued using toner in reserve tank 20 while toner supply from toner cartridge 8 is stopped.

Thereafter, it is checked whether the trouble with toner cartridge 8 has been solved (Step S113), and if the trouble has been solved, the operation returns to the top of the operation flow to continue the printing operation.

On the other hand, when the trouble has not been solved yet at Step S113, then it is determined whether toner remains in reserve tank (Step S114). If toner remains in reserve tank 20, the operation returns to Step S112 so that motor 8T as the toner supply driver of toner cartridge 8 is stopped from operating (Step S112) while motor 20R as the toner supply driver of reserve tank 20 alone is continued to operate. When no toner remains in reserve tank 20 at Step S114, the printing operation of image forming apparatus 1 is disabled, so that the printing operation is ended (Step S110).

That is, the printing operation of image forming apparatus 1 in the present embodiment is continued before the trouble with toner cartridge 8 is solved or until toner in reserve tank 20 is used up. In other words, even if a trouble has occurred in toner cartridge 8, developing device 14 is enabled to continue the printing operation without cessation of the image forming operation by using toner in reserve tank 20. Accordingly, it is possible to avoid degradation of printing efficiency due to trouble occurring in toner cartridge 8. In this case, for example, the weight of toner in toner cartridge 8 is 1,000 g and the toner capacity of reserve tank 20 is 300 g. If trouble occurs in toner cartridge 8 in this condition, further printing of 15,000 pages can be done at 6% coverage of originals, so that it is possible to have a service person or the like deal with the trouble.

Figure 10:
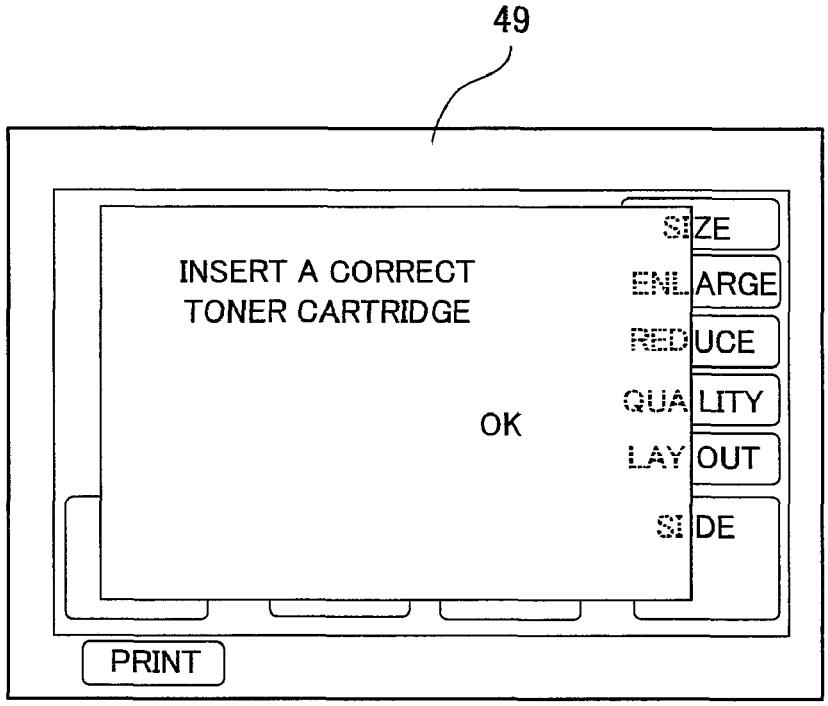

At the same time, in order to inform the user of the occurrence of trouble with toner cartridge 8 through a monitor display, a message as shown in FIG. 10 is displayed on display portion 49 of image forming apparatus 1. This notice of the occurrence of trouble with toner cartridge 8 given to the user enables the user to take quick action against the trouble of toner cartridge 8 without lowering job or operation efficiency.

Further, when trouble has occurred in toner cartridge 8, a message "Though trouble has occurred approx 500 pages can be printed for A4 sized character originals" may be displayed on display portion 49 or such a notice may be given through another indicator such as a separately arranged monitor or the like. Thus, the user is given a notice by the indicator about the approximate number of printable pages calculated based on the residual quantity of toner in reserve tank 20, hence it is possible for the user to take immediate measures before all the toner in the reserve tank is used up and minimize downtime of the printing operation of the image forming apparatus.

As described heretofore, provision of residual toner quantity detectors 55 and 27 for detecting the residual quantities of toner stored in reserve tank 20 and toner cartridge 8 that constitute toner supply portions of toner supply device 9 enables detection of whether toner supply from reserve tank 20 as well as from toner cartridge 8 is correctly performed. Accordingly, the drives of reserve tank 20 and toner cartridge 8 for the toner supply device can be controlled in accordance with the status of the toner supply operation of toner supply device 9, hence it is possible to suppress the lowering of printing efficiency of image forming apparatus 1.

In particular, when the residual toner quantity in toner cartridge 8 does not vary despite the reserve tank 20 and toner cartridge 8 being driven in order to supply toner to developing device 14, it can be determined that toner supply from toner cartridge 8 to reserve tank 20 is not being effected or that trouble has occurred in toner cartridge 8. Accordingly, even if trouble has occurred in toner cartridge 8, the printing operation is enabled without cessation of image forming processing using the toner in reserve tank 20, hence it is possible to reduce downtime without lowering printing efficiency.

The image forming apparatus of the present invention is not limited to the above configuration, but it is possible to add various modifications described as follows.

For example, in the first embodiment of the present invention, the total count of revolutions is transmitted as the detected residual toner quantity information from wireless IC tag 27 to controller 7 so that controller 7 calculates the residual toner quantity from the total count of the revolutions. However, the present invention should not be limited to this. That is, the residual toner quantity may be calculated in the wireless IC tag from the total count of the revolutions based on the above Eq. (1) and the calculated result may be transmitted as the detected residual toner quantity information to controller 7. In this case, as the wireless IC tag it is necessary to use one that can store the initial quantity of toner stored when toner cartridge 8 was manufactured and the amount of toner discharged from toner cartridge 8 every revolution, in advance and further includes a residual quantity calculator for calculating the amount of toner remaining in toner cartridge 8 from the total count of the revolutions of toner cartridge 8 detected by revolution counter 44.

As the residual toner quantity detector for detecting the residual quantity in toner cartridge 8 is not limited to the configuration using a wireless IC tag or wireless transmitter/receiver, but a wired transmitter/receiver may be used to send the detected residual toner quantity information to the controller. Nevertheless, use of a wireless IC tag or wireless transmitter/receiver is still advantageous since it is possible to impart layout flexibility of the toner cartridge and controller, hence contribute to space saving of the apparatus.

Further, the residual toner quantity detector is not necessarily limited to the wireless IC tag configuration including an IC chip as a non-volatile memory device provided to each toner cartridge.

As a toner cartridge configuration with no wireless IC tag, use of a toner weight sensor as a residual toner quantity detector may be considered. A toner weight sensor as a residual toner quantity detector is disposed under each of multiple toner cartridges so as to detect the weight of each toner cartridge. The controller has the empty weight of the toner cartridge stored in advance. The weight of the toner cartridge detected by the toner weight sensor is input to the controller through a wired or wireless means. In this configuration, it is possible to detect the amount of toner in the toner cartridge from the measurement of the toner weight sensor and the empty weight of the toner cartridge that has been stored in advance.

As another toner cartridge configuration with no wireless IC tag, use of a position sensor as a residual toner quantity detector may be considered. In an image forming apparatus with this configuration, an elastic member or a spring element is arranged under each toner cartridge. A toner cartridge is placed on the spring. When the toner cartridge is filled with toner, the spring element is pressed down by the weight of the full toner cartridge and the toner cartridge is positioned at the lowest position. As the toner is consumed, the total weight of the toner cartridge becomes lighter, so that the position of the toner cartridge moves upwards by virtue of the repulsive force of the spring element or by extending deformation. Further, to detect the residual toner quantity, a position sensor for detecting the amount of displacement of the toner cartridge whose position varies depending on the quantity of toner remaining in the toner cartridge is provided as a residual toner quantity detector for the image forming apparatus while the table data relating the amount of displacement of the toner cartridge to be detected by the position sensor to the quantity of toner remaining in toner cartridge needs to be stored in advance in the controller. The amount of displacement of the toner cartridge detected by the position sensor is input to controller through a wired or wireless means. In this configuration, it is possible to detect the quantity of toner in the toner cartridge from the amount of displacement of the toner cartridge.

Having described the preferred embodiment of the present invention with reference to the attached drawings, it goes without saying that the present invention should not be limited to the above-described examples, and it is obvious that various changes and modifications will occur to those skilled in the art within the scope of the appended claims. Such variations are therefore understood to be within the technical scope of the present invention.

For example, in the above embodiment, the toner supply device of the present invention is applied to a monochrome image forming apparatus having one toner cartridge mounted therein, but the toner supply device of the present invention can also be applied to a color image forming apparatus.

What is claimed is:

1. A toner supply device for supplying toner to a developing device for developing an electrostatic latent image formed on an image bearer, comprising:

a first toner supply portion for supplying toner to a developing hopper of the developing device;

a second toner supply portion for supplying toner stored therein to the first toner supply portion;

a first toner supply driver for driving the first toner supply portion when supplying the toner fed from the second toner supply portion to the developing device;

a first residual toner quantity detector for detecting the residual quantity of toner stored in the first toner supply portion;

a second toner supply driver for driving the second toner supply portion when supplying the toner stored in the second toner supply portion to the first toner supply portion;

a second residual toner quantity detector for detecting the residual quantity of toner stored in the second toner supply portion; and a controller for controlling the drives of the first and second toner supply drivers by switching on and off the drives of the first and second toner supply drivers in accordance with the residual toner quantities detected by the first and second residual toner quantity detectors, wherein when, while both the first and second toner supply drivers are being driven, the controller detects that the residual quantity of toner in the first toner supply portion is equal to or lower than a predetermined level, by means of the first residual toner quantity detector, the controller controls the drives of the first and second toner supply drivers so as to keep driving the first toner supply driver and stop driving the second toner supply driver.

2. The toner supply device according to claim 1, wherein the second residual toner quantity detector includes non-volatile memory in which detected residual toner quantity information as the information as to the residual quantity of toner inside the second toner supply portion is stored.

3. The toner supply device according to claim 2, wherein the second residual toner quantity detector includes a first wireless transmitter/receiver for transmitting the detected residual toner quantity information stored in the non-volatile memory to the outside; and the controller includes a second wireless transmitter/receiver for receiving the detected residual toner quantity information transmitted from the first wireless transmitter/receiver and controls the second toner supply driver of the second toner supply portion in accordance with the detected residual toner quantity information obtained by the second wireless transmitter/receiver.

4. The toner supply device according to claim 1, wherein the second toner supply portion includes a container for storing the toner and a rotational driver for rotationally driving the container; and the second toner supply driver is the rotational driver for rotationally driving the container, and the rotational driver rotationally drives the container to thereby supply toner to the first toner supply portion.

5. The toner supply device according to claim 2, wherein the second toner supply portion includes a revolution count detector for detecting the number of revolutions of the container and a residual quantity calculator for calculating the residual quantity of toner stored in the container from the total count of revolutions detected by the revolution count detector; and the residual toner quantity calculated by the residual quantity calculator is stored in the non-volatile memory as the detected residual toner quantity information.

6. The toner supply device according to claim 4, wherein the second toner supply portion includes a drive torque detector for detecting the drive torque of the rotational driver.

7. The toner supply device according to claim 1, wherein the first residual toner quantity detector is an optical detector or piezoelectric detector.

8. The toner supply device according to claim 1, further comprising a display portion for displaying an indication of a trouble occurring in the second toner supply portion when, while both the first and second toner supply drivers are being driven, the residual quantity of toner stored in the first toner supply portion is detected to be equal to or lower than a predetermined level by means of the first residual toner quantity detector.

9. The toner supply device according to claim 1, further comprising an indicator for informing the number of printable pages when, while both the first and second toner supply drivers are being driven, the residual quantity of toner stored in the first toner supply portion is detected to be equal to or lower than a predetermined level by means of the first residual toner quantity detector.

10. A developing device for forming a toner image on an image bearer by developing an electrostatic latent image formed on the image bearer, characterized in that toner is supplied from a toner supply device according to claim 1.

11. An image forming apparatus including an image bearer for supporting an electrostatic latent image and a developing device according to claim 10 for visualizing the electrostatic latent image on the image bearer with toner.

* * * * *